US005994636A

United States Patent [19]

Huntley

[11] Patent Number: 5,994,636

[45] Date of Patent: Nov. 30, 1999

[54] GUITAR REPAIR TOOL

[76] Inventor: C. Frederick M. Huntley, 233 Forest Home Dr., Ithaca, N.Y. 14850

[21] Appl. No.: 09/149,744

[22] Filed: Sep. 8, 1998

[51] Int. Cl.[6] ..... G10G 7/00

[52] U.S. Cl. ..... 84/458; 403/396; 84/280

[58] Field of Search ..... 84/458, 280, 281, 84/289, 328; 403/396, 389, 391

[56] References Cited

U.S. PATENT DOCUMENTS 1,332,621 3/1920 Ganiere .

1,459,591 6/1923 King .

OTHER PUBLICATIONS

Stewart MacDonald's Guitar Shop Supply, Apr. 1, 1998, p. 16.

*Primary Examiner*—Robert E. Nappi
*Assistant Examiner*—Kim Lockett
*Attorney, Agent, or Firm*—Huntley & Associates

[57] ABSTRACT

Clamping tool especially suitable for guitar repair which can be inserted into the sound hole of a guitar, with tensioning means spaced from the point at which force is applied to the instrument.

7 Claims, 2 Drawing Sheets

GUITAR REPAIR TOOL

BACKGROUND OF THE INVENTION

The guitar has been used for centuries, and has become one of the world's most popular instruments. In recent years, renewed interest in vintage guitars has created a demand for the repair of older instruments. One frequent need for repair of these instruments is replacement or reattachment of the bridge, which requires clamping of the guitar through the sound hole. A variety of "C" clamps have previously been used which exert force on the bridge through pressure at the ends of the clamp, the pressure being applied either through screws or lever action at the point to which pressure is desired. However, previous clamping devices have not been entirely satisfactory because of either or both of difficulty in manufacturing or lack of adjustibility.

SUMMARY OF THE INVENTION

The present invention provides a clamping apparatus which can be easily fabricated, is adaptable to a wide variety of lengths for applying clamping force, and can be safely used for the repair of delicate instruments such as guitars.

Specifically, the present invention provides a clamping apparatus consisting essentially of two elongate and substantially parallel members each having first and second ends, each elongate member being attached at the first end to a spacer, the elongate members being spaced apart on the spacer at a fixed distance of about from 2 to 3 inches, and tensioning means adjacent the first end and spaced from the first end by about from 2 to 4 inches, the tensioning means adapted to force the second ends of the parallel members toward each other.

DETAILED DESCRIPTION OF THE INVENTION

Figure 1:
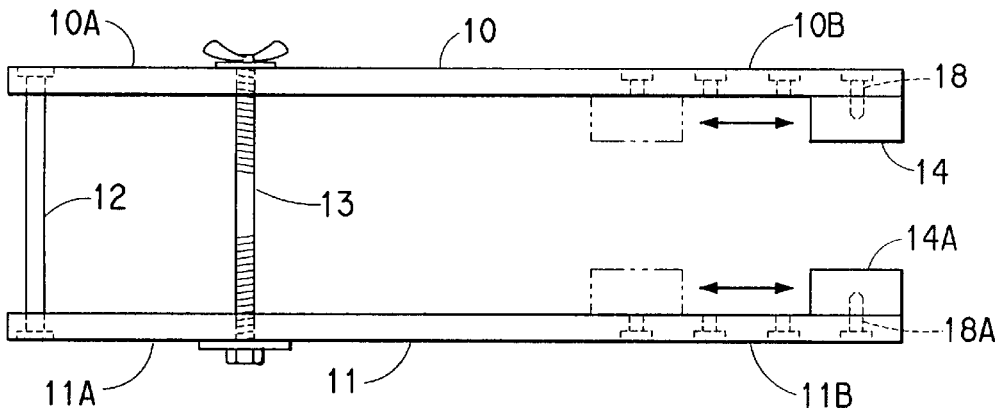
FIG. 1 is a side view of a clamping apparatus of the present invention.

With reference to the Figures, a side view of an apparatus of the present invention is shown in FIG. 1. There, two elongate and substantially parallel members 10 and 11 are provided, each having first and second ends respectively identified as 10A and 10B and 11A and 11B. Each elongate member is rotatably attached at its first end to a spacer 12. The elongate members are spaced apart on the spacer at a fixed distance of about from 2 to 3 inches. A fixed distance of about 2.5 inches has been found to be particularly satisfactory. The overall length of the elongate members can vary with the particular instrument to be repaired. However, in general, they will be about from 6 to 12 inches. A tensioning means 13 is provided adjacent the first end and spaced from the first end by about from 2 to 4 inches. The tensioning means is adapted to force the second ends of the parallel members 10B and 11B toward each other. Preferably, the distance between the first end and the tensioning means is about from 2.5 to 3.5 inches. The tensioning means is preferably removable, to facilitate installation of the apparatus into a guitar. The tensioning means is also preferably threaded, and the tension provided by a variety of known means such as a conventional nut, a wing nut, or a knurled nut.

The spacer 12 to which the two elongate members are attached can similarly be a threaded rod, fitted with substantially rigid sleeves to separate the elongate members by the desired distance. The sleeves can be prepared from a wide variety of materials, including metals and polymeric materials. Nylon has been found to be particularly satisfactory because of its ready availability and durability.

Figure 3:
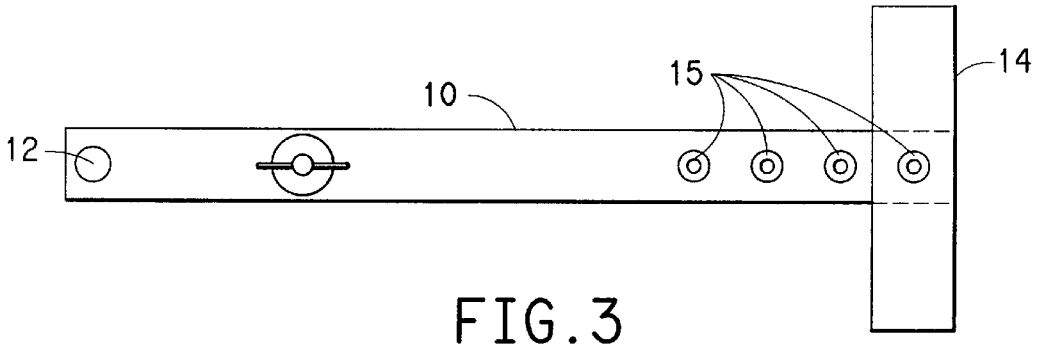
FIG. 3 is a top view of a clamping apparatus of the present invention, comprising the preferred force transmittal means.
Figure 3A:
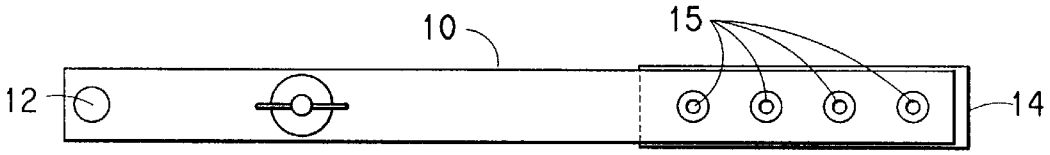
FIG. 3A is a top view of a clamping apparatus as shown in FIG. 3, with the force transmittal means rotated to be parallel with the elongate members.

Biasing, or force transmittal, means 14 and 14A are preferably provided, and attached to the second end of at least one of the substantially parallel members by any desired securing means 18 and 18A. Wood screws can be used if the biasing means are wood. The point of attachment of each of these means is the point at which pressure is to be applied to an instrument being repaired. As such, the attachment of the biasing means is preferably linearly adjustable along the parallel elongate member on which it is attached. In FIG. 1, the biasing means are attached at the end of the elongate members, with an alternative position shown in phantom closer to the first end of the elongate members. It is also preferred that the biasing means be rotatable, to facilitate insertion into the instrument being repaired. This is illustrated in FIGS. 3 and 3A. In FIG. 3, the biasing means 14 is attached at the endmost of apertures 15. In FIG. 3A, the biasing means is attached at an aperture closer to the first end of the elongate member and rotated to a position that is parallel to the elongate member for ease of insertion into the instrument.

In the use of the present clamping apparatus, measurement should be taken of the distance between the rear of the sound hole and the desired position of the bridge, and the biasing means, if present, adjusted along the two elongate members to impinge on the desired bridge position. The tensioning means 13 is preferably removable, and, with the tensioning means removed, the elongate members can be at different angles, facilitating insertion into the sound hole of the guitar. Insertion is further facilitated by positioning the biasing means parallel to the elongate members, as shown in FIG. 3A. Once the clamping apparatus is at least partly inserted, the tensioning means can be installed and appropriately adjusted to provide the desired tension on the bridge area 17, as shown in FIG. 2.

Figure 2:
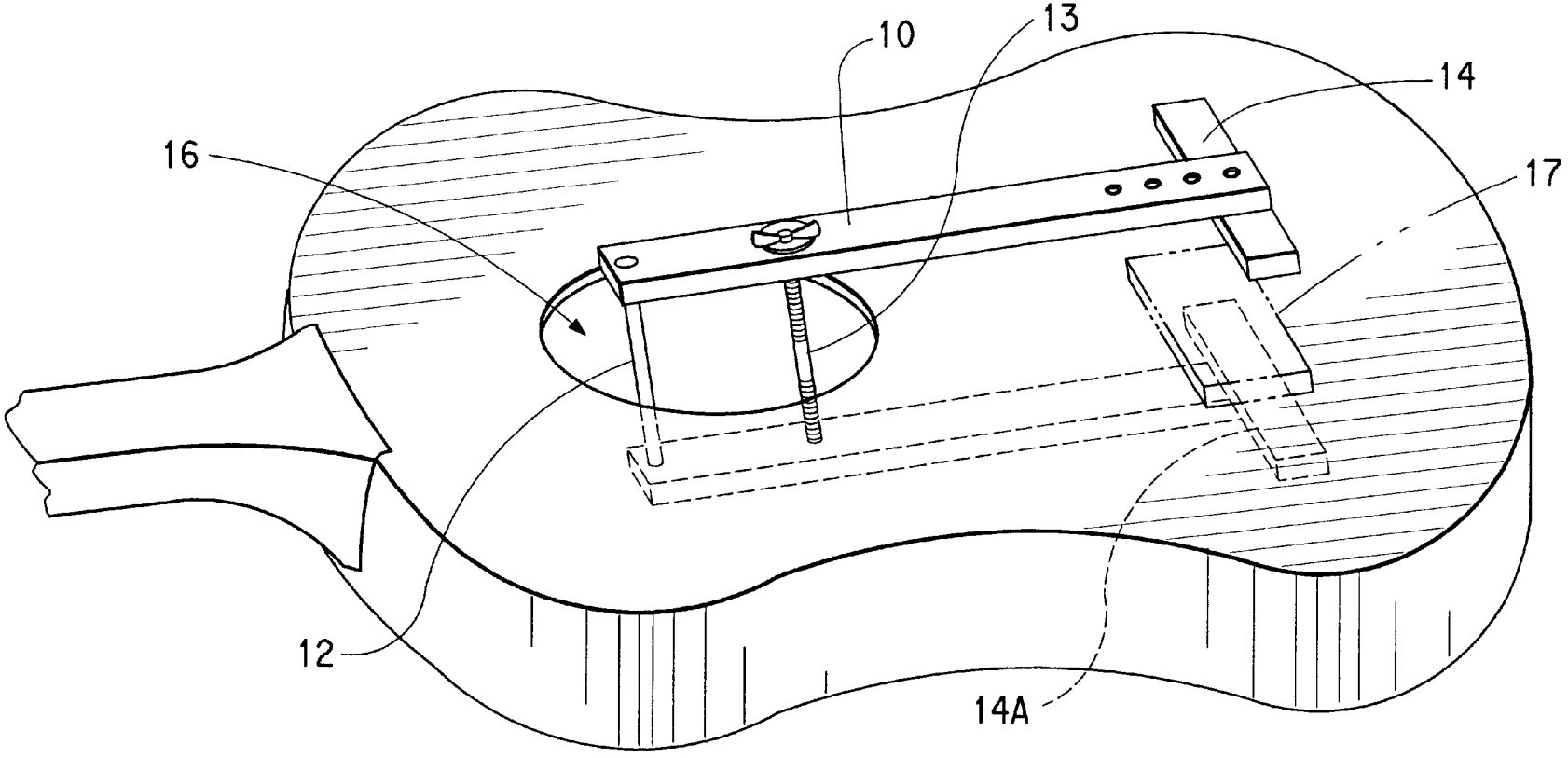
FIG. 2 is a top perspective view of a clamping apparatus of the present invention, shown in use on a guitar.

The clamping apparatus is shown operatively installed in a guitar in FIG. 2, in which the apparatus is inserted through sound hole 16. Tension is applied by adjustment of screw tensioning means 13 at the ends of the elongate members to area 17 of the instrument, at which the bridge is affixed. The tension is transmitted to the bridge area through force transmitting means 14 and 14A, which can be padded with a variety of cushioning or elastomeric materials.

The apparatus of the present invention is particularly well suited for use in the repair of a wide variety of stringed instruments having a soundhole and for which repair or replacement of the bridge is needed. In addition, the apparatus is characterized by ease of use and simplicity of construction.

I claim:

1. A clamping apparatus consisting essentially of two elongate and substantially parallel members, each having first and second ends and an overall length of about from 6 to 12 inches, each elongate member being attached at the first end to a spacer, the elongate members being spaced apart on the spacer at a fixed distance of about from 2 to 3 inches, and tensioning means adjacent the first end and spaced from the first end by about from 2 to 4 inches, the tensioning means positioned to force the second ends of the parallel members toward each other.

2. A clamping apparatus of claim 1 wherein the fixed distance between the first end and the tensioning means is about from 2.5 to 3.5 inches.

3. A clamping apparatus of claim 1 wherein the fixed distance between the first ends of the elongate members is about 2.5 inches.

4. A clamping apparatus of claim 1 wherein the tensioning means is removable.

5. A clamping apparatus of claim 1 further comprising biasing means adjustably attached to the second end of at least one of the substantially parallel members.

6. A clamping apparatus of claim 5 wherein each biasing means is rotatably attached to the parallel elongate member.

7. A clamping apparatus of claim 5 wherein each biasing means is linearly adjustable along the parallel elongate member on which it is attached.

* * * * *